US006178907B1

(12) United States Patent
Shirah et al.

(10) Patent No.: US 6,178,907 B1
(45) Date of Patent: Jan. 30, 2001

(54) STEERING SYSTEM FOR WATERCRAFT

(76) Inventors: David C. Shirah, 4205 David Dr., Metairie, LA (US) 70003; David C. Hackney, 1413 N. Woodlawn Ave., Metairie, LA (US) 70001

( * ) Notice: Under 35 U.S.C. 154(b), the term of this patent shall be extended for 0 days.

(21) Appl. No.: 09/300,708

(22) Filed: Apr. 27, 1999

(51) Int. Cl.[7] ..... B63H 25/06
(52) U.S. Cl. ..... 114/163; 114/144 R
(58) Field of Search ..... 114/144 R, 144 E, 114/162, 163, 144 RE

(56) References Cited

U.S. PATENT DOCUMENTS 1,559,816 * 11/1925 Ward ..... 114/163
3,200,783 * 8/1965 Winter ..... 114/163
3,390,614 * 7/1968 Tatum ..... 114/144 E

* cited by examiner

*Primary Examiner*—Stephen Avila
(74) *Attorney, Agent, or Firm*—Warner J. Delaune

(57) ABSTRACT

A steering system is provided for watercraft having a hull and first and second thrust producing devices capable of providing forward or reverse thrust relative to the hull, wherein the first and second thrust producing devices provide thrust along first and second thrust axes, respectively, comprising a first rudder assembly positioned forward of the first thrust producing device, wherein the first rudder assembly is pivotally connected beneath the hull; a second rudder assembly positioned forward of the second thrust producing device, wherein the second rudder assembly is pivotally connected beneath the hull; first actuation device operatively connected to the first rudder assembly for actuating a change in the rotational position of the first rudder assembly; second actuation device operatively connected to the second rudder assembly for actuating a change in the rotational position of the second rudder assembly; and a control device operatively connected to the first and second actuation devices for controlling the rotational position of the first and second rudder assemblies independent of one another, the control device further including a selector for selectively defining the operation of the first rudder assembly or the second rudder assembly in one or more predetermined configurations.

28 Claims, 8 Drawing Sheets

STEERING SYSTEM FOR WATERCRAFT

BACKGROUND OF THE INVENTION

I. Field of the Invention

The present invention relates generally to steering systems for watercraft, and more particularly to the definition and control of predetermined rudder configurations used in maneuvering watercraft.

II. Description of Prior Art

Flanking rudders, as the term is used herein, are rudders which are located forward of the main thrust producing device(s), typically propellers or "screws," for a particular watercraft. Whether the watercraft includes a single screw or several, it would be common to employ a flanking rudder directly in front of each of the screws. The basic concept of flanking rudders has been understood at least as early as the 1800's when such rudders were used in connection with paddle wheeled steamboats. At the present time, flanking rudders are commonly installed on towboats that push barges on the inland river systems of North and South America. The primary function of flanking rudders is to provide the watercraft with a means of steering as the watercraft travels in reverse. For example, as the screws or other thrust-producing device directs reverse thrust toward the front of the watercraft, the flanking rudders are employed in tandem to steer the watercraft in the desired direction. This is particularly useful in the case of utility boats, such as tug boats, which routinely change from forward and reverse thrust in assisting larger ships, such as oil tankers and cargo ships, into a docking position in a river; with towboats that push barges on inland rivers and coastal waters; and, seagoing vessels.

Although the presence of flanking rudders operating in tandem mode is a significant enhancement to the maneuverability of any of these types of vessels, there are situations where greater control over the operation of the flanking rudders would be highly desirable. For example, in many instances, tug boats must attach to one side of a ship having a deeper draft than the tug boat. When reverse thrust is applied over conventional flanking rudders to pull the larger ship, the thrust is necessarily directed against the hull of the larger ship. The undesirable effect is for the stem of the tug boat to be urged away from the ship, thus losing some control over the larger ship. While lines can be used to tie the tug boat to the larger ship, this is an imperfect solution. Ideally, the flanking rudders would be subject to independent control to allow the innermost flanking rudder to remain parallel to the keel of the ship, while the outermost flanking rudder is used to direct thrust in the desired direction. Also, once independent control of the flanking rudders is implemented, it would be quite useful to operate the flanking rudders in a converging or diverging mode, such that the flanking rudders can be placed in a flared position for braking when the vessel is moving forward or moving astern, and for redirection of thrust. Consequently, the present invention is provided as a solution to the foregoing problems by illustrating a novel flanking rudder steering system capable of being controlled in a variety of predefined operational modes by one or more controlling devices.

SUMMARY OF THE INVENTION

It is therefore an object of this invention to provide a steering system for watercraft which employs flanking rudders for use in connection with reverse thrust.

It is also an object of this invention to provide a steering system for watercraft which allows independent control of the flanking rudders.

It is a further object of this invention to provide a steering system for watercraft which permits the selection of one or more predetermined rudder control configurations useful to operators in the maneuverability of the watercraft.

Yet another object of this invention is to provide a steering system for watercraft which employs flanking rudders and an accompanying control system which be retrofitted to existing watercraft.

These and other objects and advantages of the present invention will no doubt become apparent to those skilled in the art after having read the following description of the preferred embodiment which are contained in and illustrated by the various drawing figures.

Therefore, in a preferred embodiment, a flanking rudder system is provided for watercraft having a hull and first and second thrust producing devices capable of providing forward or reverse thrust relative to said hull, wherein said first and second thrust producing devices provide thrust along first and second thrust axes, respectively, comprising a first rudder assembly positioned forward of said first thrust producing device, wherein said first rudder assembly is pivotally connected beneath said hull; a second rudder assembly positioned forward of said second thrust producing device, wherein said second rudder assembly is pivotally connected beneath said hull; first actuation means operatively connected to said first rudder assembly for actuating a change in the rotational position of said first rudder assembly; second actuation means operatively connected to said second rudder assembly for actuating a change in the rotational position of said second rudder assembly; and control means operatively connected to said first and second actuation means for controlling the rotational position of said first and second rudder assemblies independent of one another, said control means further including selection means for selectively defining the operation of said first rudder assembly or said second rudder assembly in one or more predetermined configurations. While it is generally contemplated that the first and second thrust producing devices are propellers, it is also possible that the thrust may be produced by other means.

In one embodiment, said first rudder assembly and said second rudder assembly each include a single rudder. However, in an alternate embodiment, said first rudder assembly and said second rudder assembly each include a pair of rudders connected to said first actuation means and said second actuation means, respectively, so as to enable said pair of rudders to remain parallel at all rotational positions. Although not specifically required, said first actuation means and said second actuation means each comprise an electro-hydraulic mechanical linkage assembly.

The control means comprises at least one control lever operatively connected to said first actuation means and said second actuation means, respectively, to control the rotational position of either said first rudder assembly or said second rudder assembly. Furthermore, the selection means comprises a console adjacent to said control means, wherein said console includes an electrical switching device having a plurality of selectable settings corresponding to said predetermined configurations.

One of said predetermined configurations defines said first rudder assembly and said second rudder assembly to operate in tandem, such that operation of said control means causes said first and second rudder assemblies to remain parallel to one another. Another of said predetermined configurations defines said first rudder assembly to remain fixed in a rotational position parallel to said first thrust axis of said first thrust producing device, and wherein the rotational position of said second rudder assembly is controlled by said control means. Another of said predetermined configurations defines said second rudder assembly to remain fixed in a rotational position parallel to said second thrust axis of said second thrust producing device, and wherein the rotational position of said first rudder assembly is controlled by said control means. Yet another of said predetermined configurations defines said first rudder assembly and said second rudder assembly to operate opposed to one another, wherein the rotational position of said first rudder assembly and said second rudder assembly are controlled by said control means.

Also, in a preferred embodiment, a method is provided for steering a watercraft having a hull and first and second thrust producing devices capable of providing forward or reverse thrust relative to said hull, wherein said first and second thrust producing devices provide thrust along first and second thrust axes, comprising: (a) providing said watercraft with a first rudder assembly positioned forward of said first thrust producing device, a second rudder assembly positioned forward of said second thrust producing device, first actuation means operatively connected to said first rudder assembly for actuating a change in the rotational position of said first rudder assembly, second actuation means operatively connected to said second rudder assembly for actuating a change in the rotational position of said second rudder assembly, and control means operatively connected to said first and second actuation means for controlling the rotational position of said first and second rudder assemblies independent of one another, said control means further including selection means for selectively defining the operation of said first rudder assembly or said second rudder assembly in one or more predetermined configurations; (b) selecting one of said predetermined configurations from said selection means; and (c) operating said first and second thrust producing devices to direct reverse thrust against said first and second rudder assemblies in said predetermined configuration.

DETAILED DESCRIPTION OF THE PREFERRED EMBODIMENTS

Figure 1A:
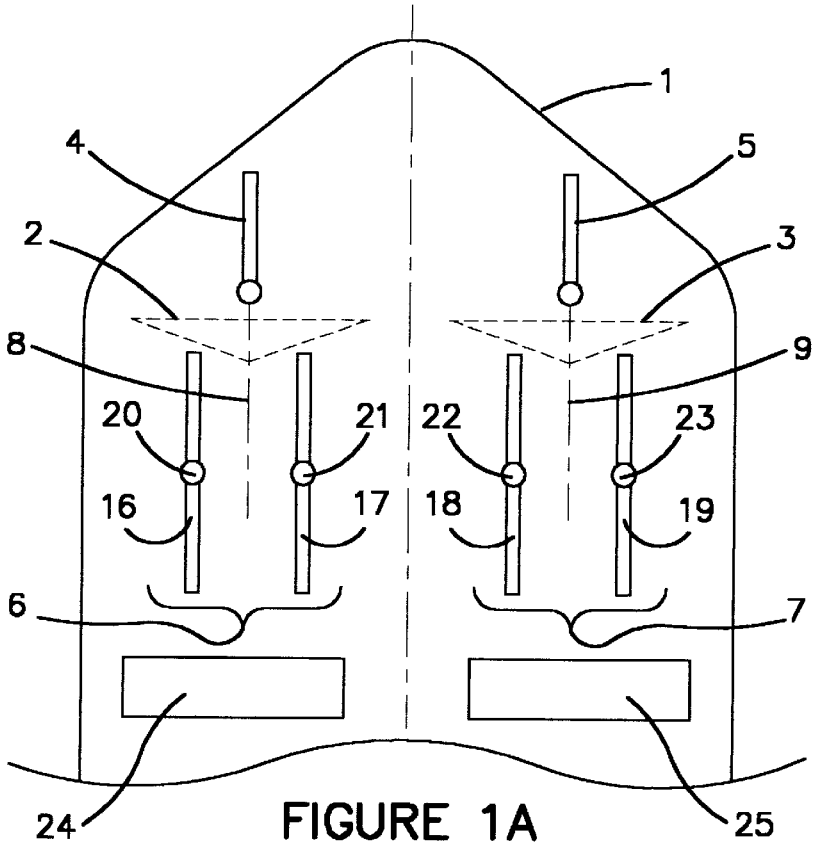
FIG. 1A is a top schematic view of the stem of a twin-screw watercraft depicting the relative positions of the screws, the main steering rudders, and the flanking rudders as the watercraft travels forward under forward thrust.

Turning now to FIG. 1A, a top schematic view is shown of the stem 1 of a twin-screw watercraft depicting, in a preferred embodiment, the relative positions of the screws 2,3, the main steering rudders 4,5, and the flanking rudder assemblies 6,7 as the watercraft travels forward under forward thrust. For the purposes herein, the screws 2,3 are only one specific example of a "thrust producing device" for causing water to be forcefully moved against the vertical surfaces of a rudder, irrespective of whether such rudders are used for main steering or as flanking rudders. Persons of ordinary skill in this field will appreciate that some other types of devices capable of producing a thrust may be equally applicable to the present invention. The screws 2,3 shown in FIG. 1A are depicted as pointing toward the bow of the watercraft, meaning that the watercraft is traveling forward as the thrust is directed aft past the main steering rudders 4,5. Each screw 2,3 includes a thrust axis 8,9 which represents the axis through which the force of the water is directed relative to the hull. It should also be noted that the principles illustrated herein are applicable for single-screw vessels, twin-screw vessels, and triple-screw vessels, including vessels having any number of thrust producing devices that employ rudders for steering the watercraft.

Figure 1B:
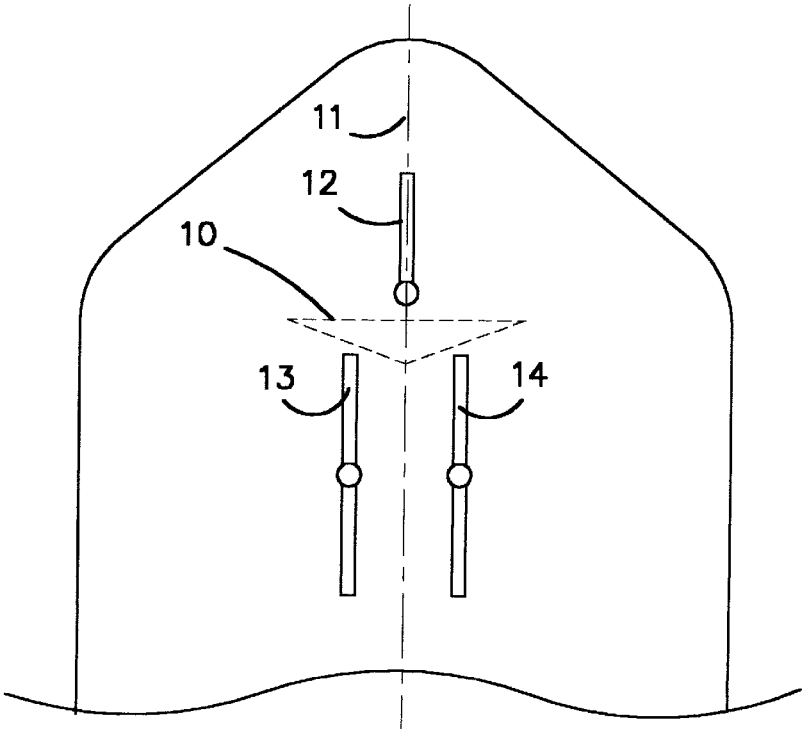
FIG. 1B is a top schematic view similar to FIG. 1A illustrating a single-screw watercraft.

With respect to a single-screw application, such a watercraft is shown traveling in a forward direction in FIG. 1B and including a single thrust producing device, or screw 10, positioned centrally along the vessel's longitudinal axis 11, a main steering rudder 12, and a pair of flanking rudders 13,14. A further explanation of the present invention with respect to both single-screw and twin-screw arrangements will now be given. Unless otherwise indicated, operation of the flanking rudders 13,14 in a single-screw application are identical to operation of the first and second flanking rudder assemblies 6,7 of the twin-screw application.

In the twin-screw version of the invention depicted in FIG. 1A, each flanking rudder assembly 6,7 is positioned forward of their respective screws 2,3, wherein each flanking rudder assembly 6,7 is comprised of a pair of rudders 16,17 and 18,19, respectively. Rudders 16,17 of the first flanking rudder assembly 6 are pivotally connected beneath the hull of the vessel via shafts 20,21. Similarly, rudders 18,19 of the second flanking rudder assembly 7 are pivotally connected beneath the hull of the vessel via shafts 22,23. Rudders 16,17 of first flanking rudder assembly 6 operate in tandem, meaning that any rotation of rudder 16 is matched by rudder 17. Similarly, rudders 18,19 of second flanking rudder assembly 7 operate in tandem, meaning that any rotation of rudder 18 is matched by rudder 19. Most importantly, first flanking rudder assembly 6 and second flanking rudder assembly 7 are capable of being controlled independently of one another. In other words, in the present invention herein described, the rotational position of first flanking rudder assembly 6 may be changed by the operator of the vessel without regard to the rotational position of second flanking rudder assembly 7, and vice versa. The flexibility of this type of operation will become clearer in the ensuing explanation of the various predetermined settings for the flanking rudder control means 34.

Figure 1C:
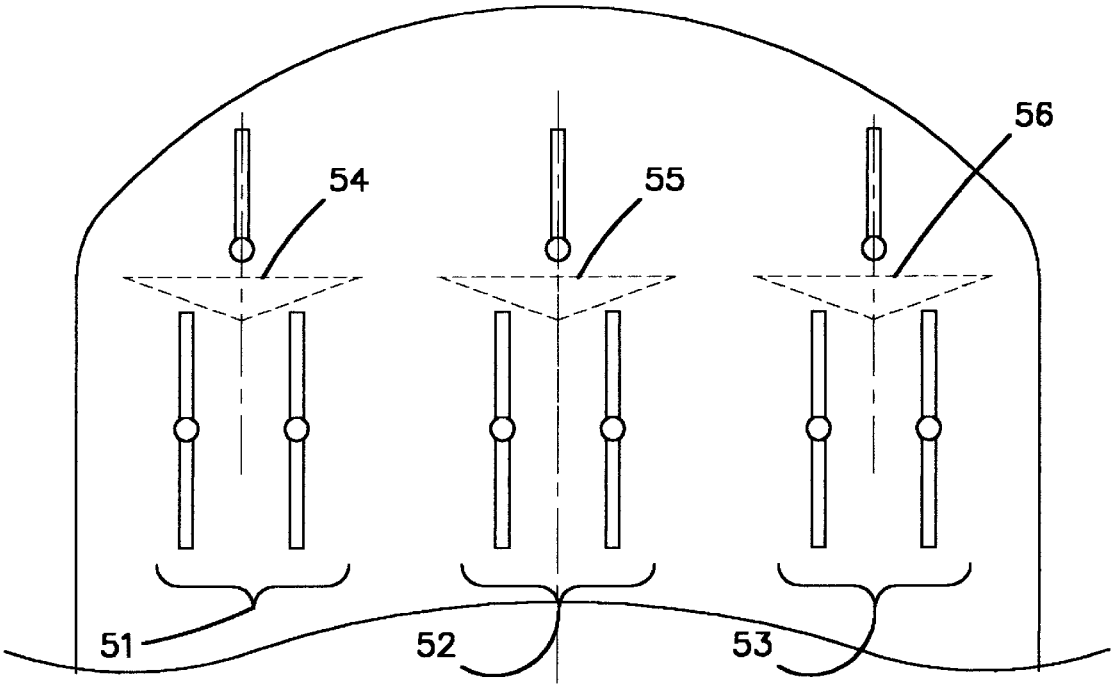
FIG. 1C is a top view schematic similar to FIG. 1A illustrating a triple-screw watercraft.

The rotational position of first and second flanking rudder assemblies 6,7 is accomplished by first actuation means 24 operatively connected to the first flanking rudder assembly 6 and by second actuation means 25 operatively connected to the second flanking rudder assembly 7. Although a wide variety of electrical and mechanical systems may be employed to effect such motion, it is preferred that both first and second actuation means 24,25 be comprised of a conventional electrical-over-hydraulic actuator. One example of such an actuator is schematically depicted in FIG. 1E, wherein each set of flanking rudder assemblies 6,7 includes a pair of control members 27,28 which are in turn rotatably connected to one another by a connecting rod 26 or "jockey bar." The connecting rod 26 is rigidly attached to the ram 29 of a hydraulic cylinder 30, while the hydraulic cylinder 30 is free to pivot about the surface to which it is attached. Suitable hydraulic hoses 31,32 connect the hydraulic cylinder 30 to an electrically operated hydraulic pump and reservoir 33, as is common understood. The hydraulic pump 33 is operated using by electricity provided by a local power supply (not shown) located on the vessel.

Importantly, the operation of the hydraulic pump 33 is controlled by the settings of the control means 34 located in the pilot house 60. The control means 34 is operatively connected to the first and second actuation means 24,25 for controlling the rotational position of the first and second rudder assemblies 6,7 independent of one another. In the specific embodiment depicted in FIG. 1E, the control means 34 includes a suitable electronic package 35 containing logic information regarding the various settings to be used by the operator. The electronic package 35 is operatively connected to the hydraulic pump 33 of the vessel such that any control commands resulting from manipulation of the control means 34 are passed through the electronic package 35 and translated into the appropriate mechanical output, e.g. changing the rotational position of the rudder assemblies 6,7.

Figure 5:
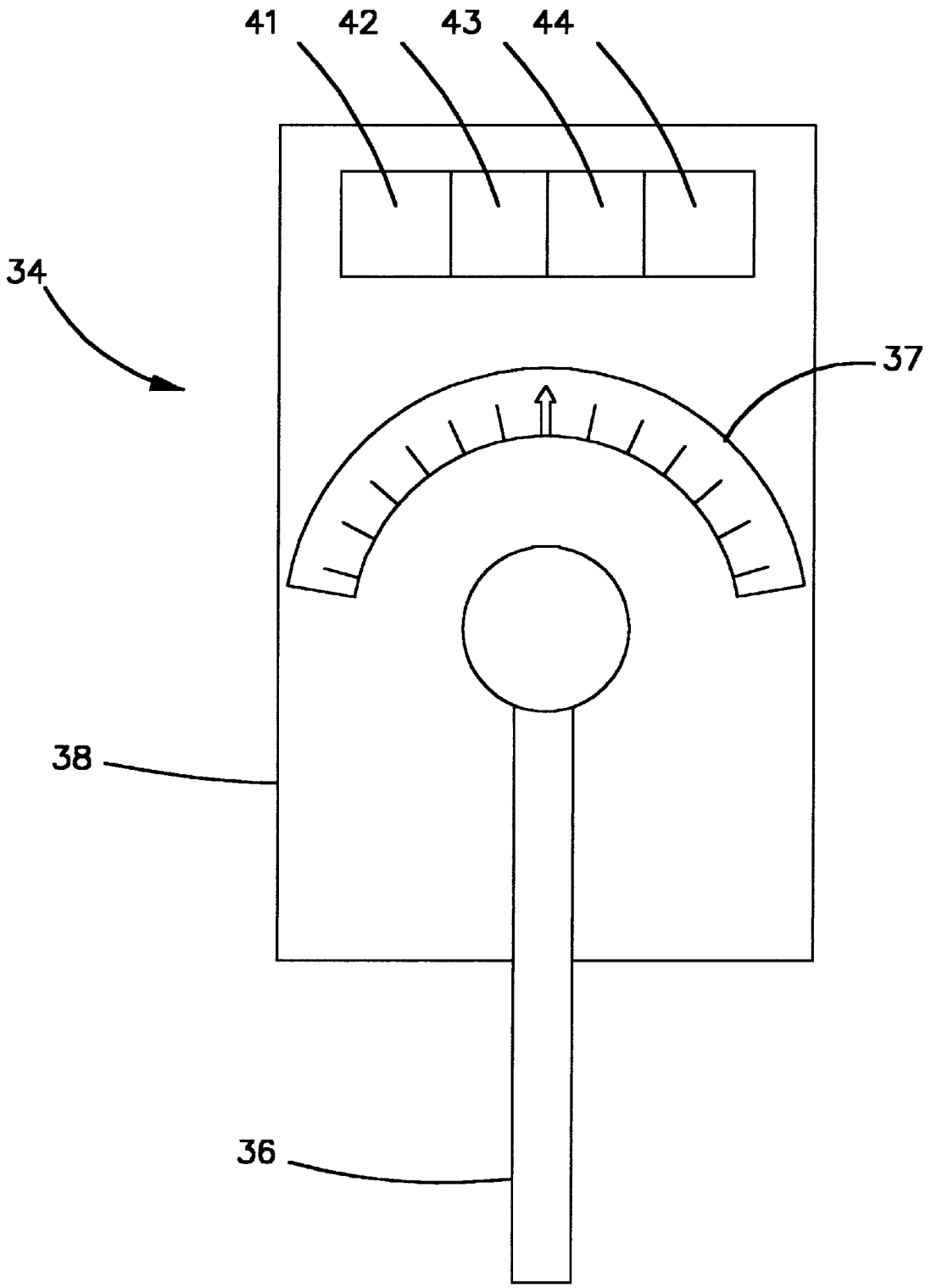
FIG. 5 is one embodiment of the control means and selection means, wherein the control lever is used to direct the position of the controllable rudders, while selection buttons are used to select one of the predetermined configurations.
Figure 6:
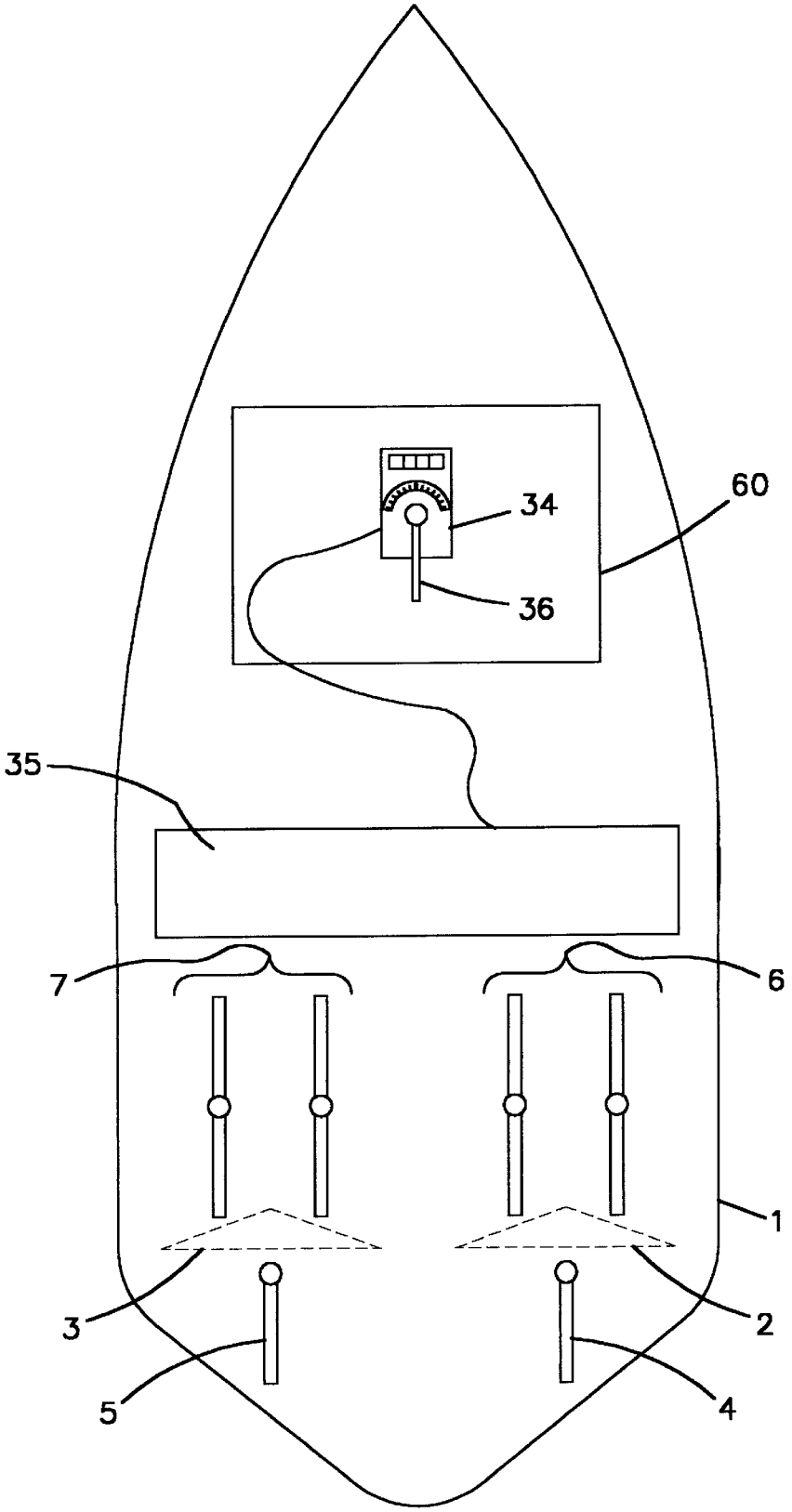
FIG. 6 is a top schematic view of a watercraft showing the manner in which the control and selections means are located within the pilot house and connected electrically to the actuation means for mechanically operating the flanking rudders.

A more detailed and specific embodiment of the control means 34 is depicted in FIG. 5. While such control means 34 may comprise a wide variety of forms, one example would comprise a base 38 having a control lever 36, an angle indicator gauge 37, and a panel of four buttons 41–44. Control lever 36 operates similarly to the control levers found on many vessels that might be retrofitted with the present invention. Simply, a vertical position of control lever 36 corresponds to a straight position of the flanking rudders assemblies 6,7, meaning that no steerage is being applied. As control lever 36 is moved in either direction, the rudder(s) being controlled will move to an angular orientation indicated by the angle indicator gauge 37. Buttons 41–44 are preferably of the type wherein depression of one button deactivates the remaining buttons such that only one of the buttons 41–44 can be activated at any given time. The purpose of each button 41–44 is to define a predetermined operational mode or configuration for the first and second rudder assemblies 6,7. Depending upon the particular operational mode selected, the effect of moving the control lever 36 will change in accordance with the following modes described below.

Figure 2A:
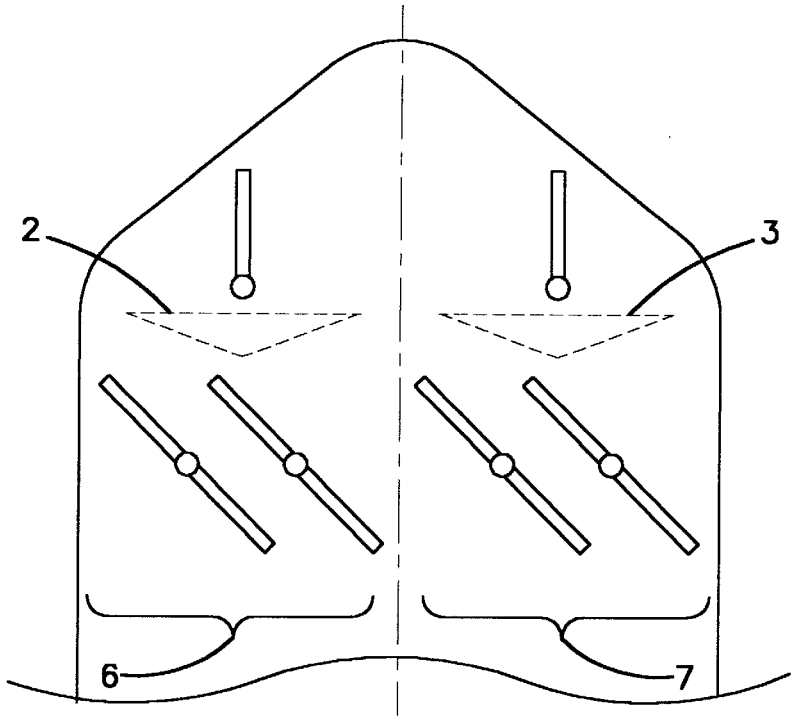
FIGS. 2A and 2B are top schematic views of the flanking rudders under tandem control and reverse thrust showing the stem of the watercraft being steered in the starboard direction and the port direction, respectively.
Figure 2B:
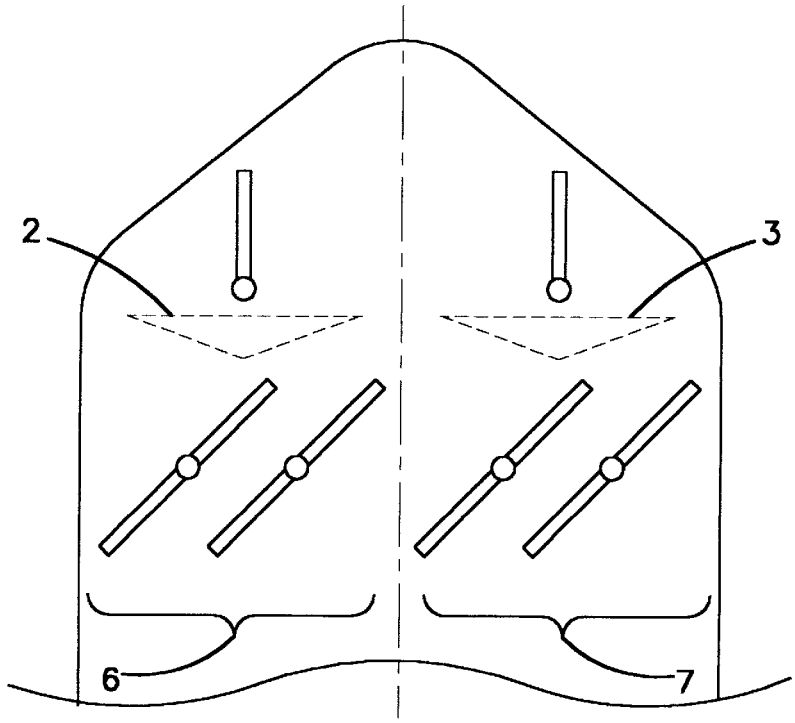
Figure 3A:
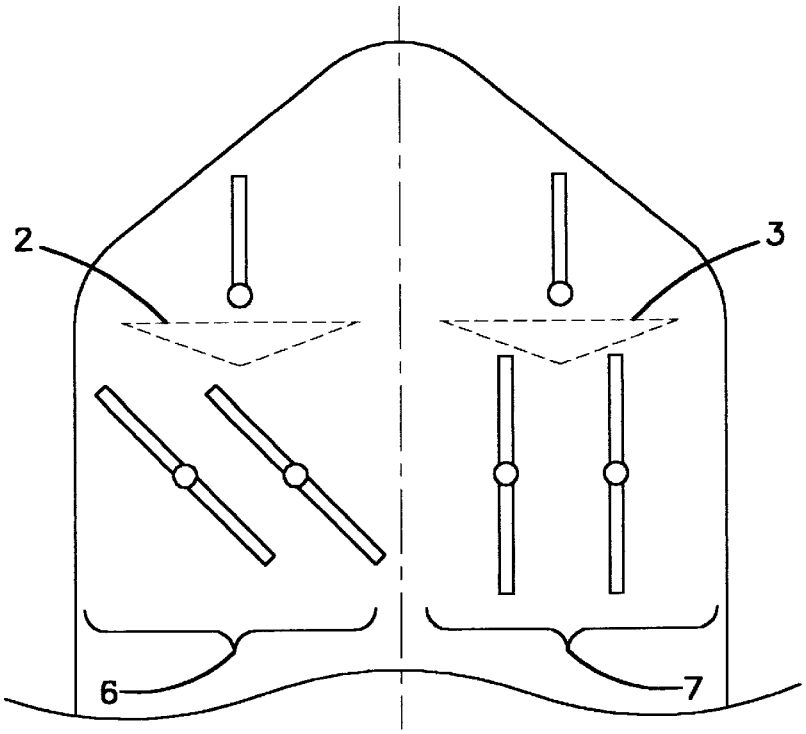
FIG. 3A is a top schematic view of the starboard flanking rudders being controlled while the port flanking rudders are fixed parallel to the thrust axis, resulting in motion of the watercraft in the starboard direction.
Figure 3B:
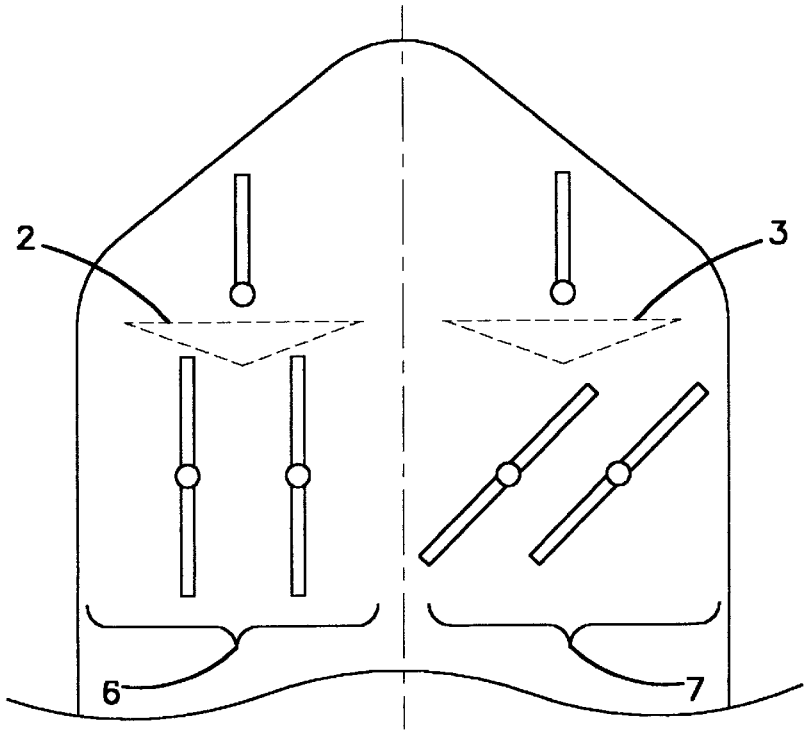
FIG. 3B is a top schematic view of the port flanking rudders being controlled while the starboard flanking rudders are fixed parallel to the thrust axis, resulting in motion of the watercraft in the port direction.
Figure 4:
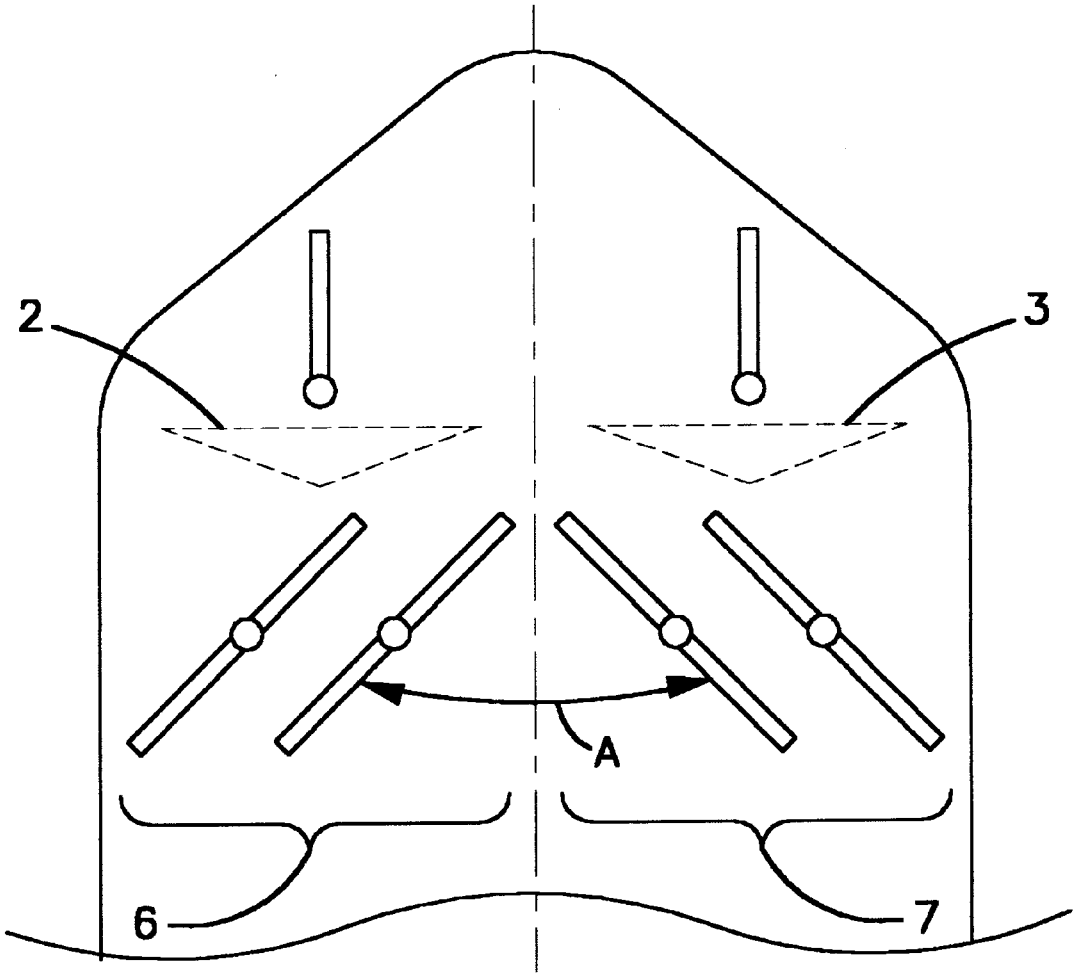
FIG. 4 is a top schematic view of the flanking rudders in a flare position, directing the thrust toward both port and starboard sides of the watercraft.

Although one example of the assignment of modes to the buttons 41–44 will be illustrated, any of the modes described herein may be assigned to any one of the buttons 41–44. Button 41 sets the flanking rudder control means 34 to tandem mode, represented best by FIGS. 2A and 2B with respect to a twin-screw vessel. In tandem mode, the rotational position of first and second rudder assemblies 6,7 are caused to be the same through their entire range of motion, which is the traditional manner in which flanking rudders have been operated. In other words, when button 41 is depressed, movement of control lever 36 causes identical movement of both first and second rudder assemblies 6,7. Button 42 sets the flanking rudder assemblies 6,7 to starboard mode, shown in FIG. 3A, which allows control lever 36 to control only the starboard rudder assembly 6, while the port rudder assembly 7 is automatically maintained in a forward or "zero azimuth" position parallel to the keel of the vessel. Similarly, button 43 sets the flanking rudder assemblies 6,7 to port mode, shown in FIG. 3B, which allows control lever 36 to control only the port rudder assembly 7, while the starboard rudder assembly 6 is automatically maintained in a forward or "zero azimuth" position. Finally, button 44 automatically sets the flanking rudder assemblies 6,7 to a flared mode, shown in FIG. 4, wherein the rotational position of rudder assemblies 6,7 are caused to operate opposed to one another through their entire range of motion. In this manner, control lever 36 is used to control the included angle A between rudder assemblies 6,7.

It should be understood and appreciated that the foregoing modes are equally applicable to triple-screw vessels. For example, in a triple-screw vessel, each of the screws 54–56 includes a flanking rudder assembly 51–53, such as that shown in FIG. 1C. In tandem mode, all three of the flanking rudder assemblies 51–53 are operated parallel to one another. In port or starboard mode, only the outermost flanking rudder assembly 51 or 53, as applicable, is independently controlled by the operator using control lever 36, while the central flanking rudder assembly 52 and the opposite flanking rudder assembly are held automatically in a forward or zero azimuth position. In flared mode, the outermost flanking rudder assemblies 51, 53 are operated in opposite rotational modes, while the central flanking rudder assembly 52 is held automatically in a forward position.

Figure 1D:
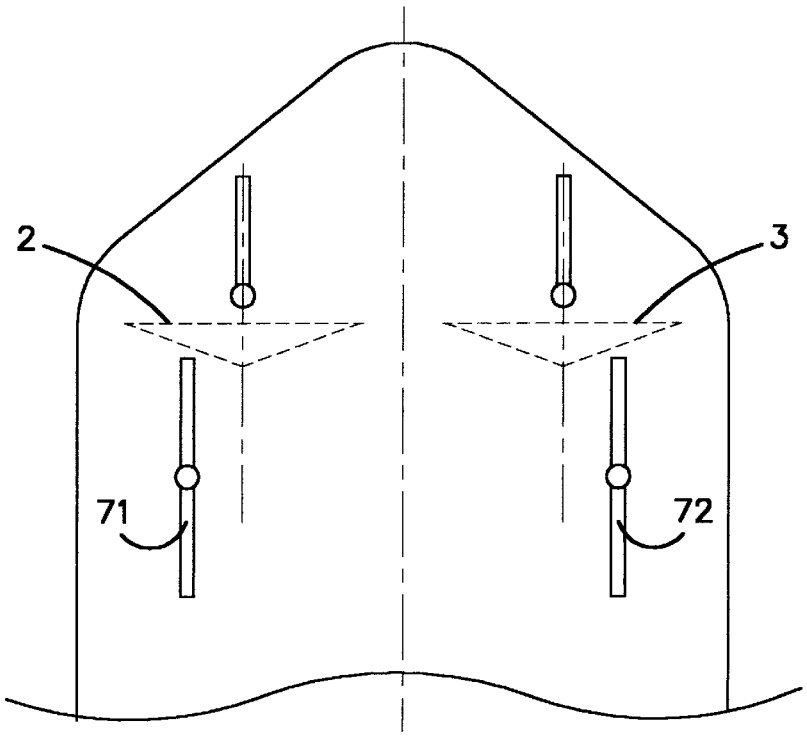
FIG. 1D is a top view schematic of an alternative embodiment of the invention.
Figure 1E:
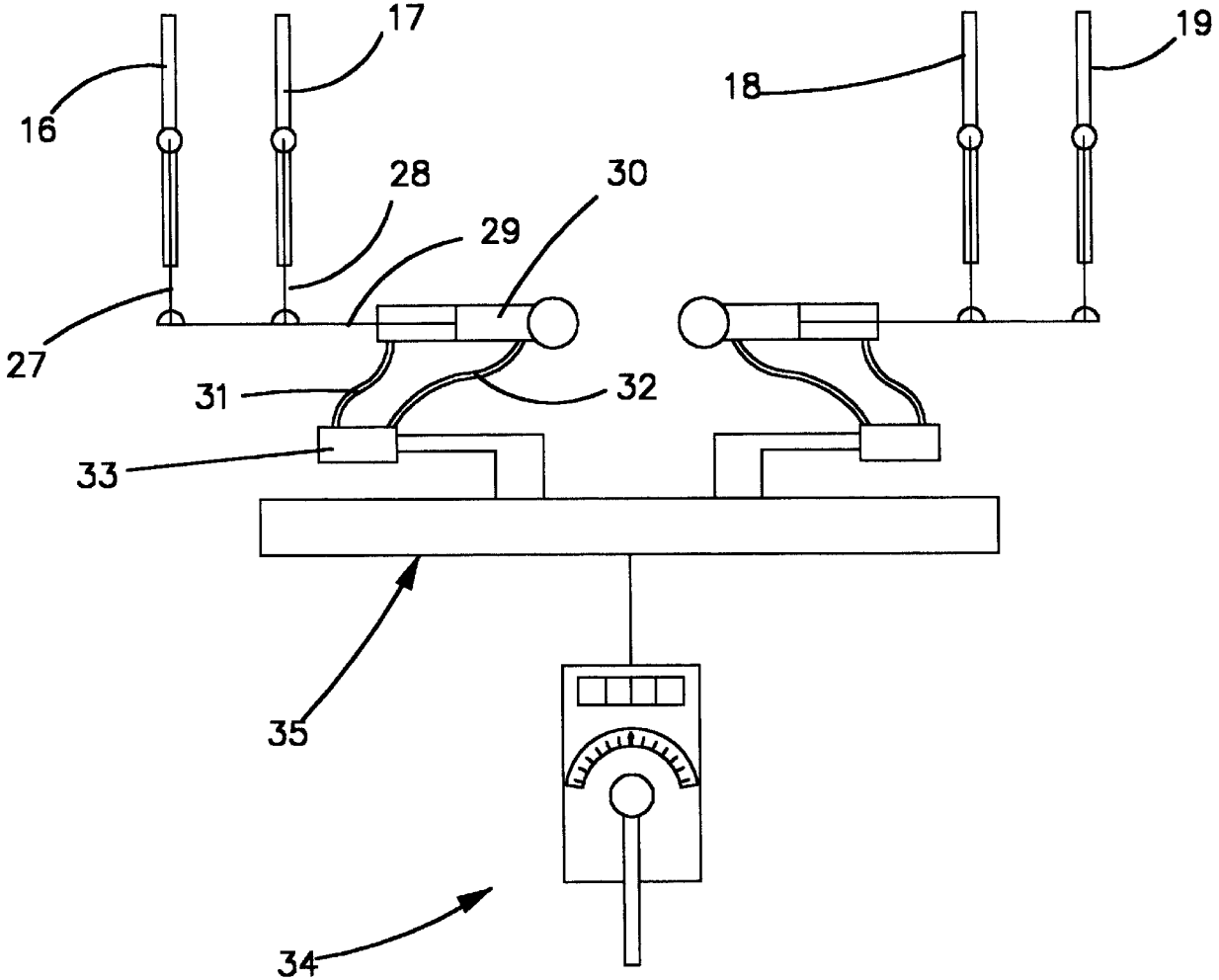
FIG. 1E is a schematic illustration of one example of an electrical-over-hydraulic actuation system for use in changing the rotational position of the flanking rudders.

Likewise, the foregoing modes are applicable to twin-screw vessels having a single flanking rudder 71,72 positioned forward of each screw 2,3, as illustrated in FIG. 1D. Because of the presence of the shaft for each screw 2,3, each flanking rudder 71,72 is typically offset toward the outside of the thrust axis 74,75. However, the method of control for these flanking rudders 71,72 is otherwise identical to the method described with respect to the flanking rudders of FIG. 1A.

The aforementioned modes of operation, in addition to the traditional tandem mode, are particularly advantageous to the operator of a ship assist tug boat for the following reasons. A ship that is operated in close proximity to another ship having a draft which is deeper than the object vessel, such a ship assist tug boat, will experience difficulty in laying along side of the deeper draft ship. In this situation, the port and starboard modes previously described will alleviate problems associated with staying close to the ship being moved. When the invention is set to operate in starboard mode or port mode, represented by buttons 42 and 43, the flanking rudder located proximal to the deeper-draft ship will remain parallel to that ship's keel, while the distal flanking rudder will be independently controlled by the control lever 36. These modes of operation are also desirable when the vessel is operated near a wharf, river locks, or the shoreline for at least two reasons. First, maneuverability of the watercraft is enhanced by increased control over the flanking rudders. Second, through the use of a predetermined rudder configuration, the operator may direct thrust in such a manner so as to reduce routing damage. In the flare position, represented by button 44, the rearward convergence of the flanking rudders 6,7 separates and directs the thrust toward port and starboard and away from the vessel's keel. This action provides substantially greater braking control than that provided by reverse thrusting past traditional flanking rudders. By directing thrust away from the keel, the cavitation that normally takes place when reverse thrust is directed under the vessel is reduced. Thus, the screws are permitted to continue to operate at maximum thrust through the non-cavitated denser medium.

Although the present invention has been described in terms of specific embodiments, it is anticipated that alterations and modifications thereof will no doubt become apparent to those skilled in the art. For example, the aforementioned concepts may also be applied to the control of steering systems positioned aft of the thrust producing devices. It is therefore intended that the following claims be interpreted as covering all such alterations and modifications as fall within the true spirit and scope of the invention.

We claim:

1. A flanking rudder system for watercraft having a hull and at least one thrust producing device capable of providing forward or reverse thrust relative to said hull and along a thrust axis, comprising:

(a) at least two rudders positioned forward of said thrust producing device, wherein each of said rudders is pivotally connected beneath said hull along pivotal axes spaced equidistantly from said thrust axis;

(b) actuation means operatively connected to each of said rudders for rotating each of said rudders about their respective said pivotal axes independently of one another; and (c) control means operatively connected to said actuation means for controlling the rotational position of each of said rudders about their respective said pivotal axes, said control means including selection means for selectively defining the rotational position of at least one of said rudders in one or more predetermined configurations, wherein said selection means comprises a console adjacent to said control means, wherein said console includes an electrical switching device having a plurality of selectable settings corresponding to said predetermined configurations.

2. The flanking rudder system of claim 1, wherein said thrust producing device is a propeller.

3. The flanking rudder system according to claim 1, wherein said actuation means comprises an electro-hydraulic mechanical linkage assembly.

4. The flanking rudder system according to claim 1, wherein said control means comprises at least one control lever operatively connected to said actuation means to control the rotational position of said rudders.

5. The flanking rudder system according to claim 1, wherein one of said predetermined configurations defines said rudders to operate in tandem, such that operation of said control means causes said rudders to remain parallel to one another.

6. The flanking rudder system according to claim 1, wherein one of said predetermined configurations defines one of said rudders to remain fixed in a rotational position parallel to said thrust axis of said thrust producing device, and wherein the rotational position of the remaining rudder is controlled by said control means.

7. The flanking rudder system according to claim 1, wherein one of said predetermined configurations defines said rudders to operate opposed to one another, wherein the rotational position of said rudders are controlled by said control means.

8. A flanking rudder system for watercraft having a hull and first and second thrust producing devices capable of providing forward or reverse thrust relative to said hull, wherein said first and second thrust producing devices provide thrust along first and second thrust axes, respectively, comprising:

(a) a first rudder assembly positioned forward of said first thrust producing device, wherein said first rudder assembly is pivotally connected beneath said hull;

(b) a second rudder assembly positioned forward of said second thrust producing device, wherein said second rudder assembly is pivotally connected beneath said hull;

(c) first actuation means operatively connected to said first rudder assembly for actuating a change in the rotational position of said first rudder assembly;

(d) second actuation means operatively connected to said second rudder assembly for actuating a change in the rotational position of said second rudder assembly; and (e) control means operatively connected to said first and second actuation means for controlling the rotational position of said first and second rudder assemblies independent of one another, said control means further including selection means for selectively defining the operation of said first rudder assembly or said second rudder assembly in one or more predetermined configurations wherein said selection means comprises a console adjacent to said control means wherein said console includes an electrical switching device having a plurality of selectable settings corresponding to said predetermined configurations.

9. The flanking rudder system of claim 8, wherein said first and second thrust producing devices are propellers.

10. The flanking rudder system according to claim 8, where said first rudder assembly and said second rudder assembly each include a single rudder.

11. The flanking rudder system according to claim 8, where said first rudder assembly and said second rudder assembly each include a pair of rudders connected to said first actuation means and said second actuation means, respectively, so as to enable said pair of rudders to remain parallel at all rotational positions.

12. The flanking rudder system according to claim 8, wherein said first actuation means and said second actuation means each comprise an electro-hydraulic mechanical linkage assembly.

13. The flanking rudder system according to claim 8, wherein said control means comprises at least one control lever operatively connected to said first actuation means and said second actuation means, respectively, to control the rotational position of either said first rudder assembly or said second rudder assembly.

14. The flanking rudder system according to claim 8, wherein one of said predetermined configurations defines said first rudder assembly and said second rudder assembly to operate in tandem, such that operation of said control means causes said first and second rudder assemblies to remain parallel to one another.

15. The flanking rudder system according to claim 8, wherein one of said predetermined configurations defines said first rudder assembly to remain fixed in a rotational position parallel to said first thrust axis of said first thrust producing device, and wherein the rotational position of said second rudder assembly is controlled by said control means.

16. The flanking rudder system according to claim 8, wherein one of said predetermined configurations defines said second rudder assembly to remain fixed in a rotational position parallel to said second thrust axis of said second thrust producing device, and wherein the rotational position of said first rudder assembly is controlled by said control means.

17. The flanking rudder system according to claim 8, wherein one of said predetermined configurations defines said first rudder assembly and said second rudder assembly to operate opposed to one another, wherein the rotational position of said first rudder assembly and said second rudder assembly are controlled by said control means.

18. A flanking rudder system for watercraft having a hull and first, second and third thrust producing devices capable of providing forward or reverse thrust relative to said hull, wherein said first, second and third thrust producing devices provide thrust along first, second and third thrust axes, respectively, comprising:

(a) a first rudder assembly positioned forward of said first thrust producing device, wherein said first rudder assembly is pivotally connected beneath said hull;

(b) a second rudder assembly positioned forward of said second thrust producing device, wherein said second rudder assembly is pivotally connected beneath said hull;

(c) a third rudder assembly positioned forward of said third thrust producing device, wherein said third rudder assembly is pivotally connected beneath said hull;

(d) first actuation means operatively connected to said first rudder assembly for actuating a change in the rotational position of said first rudder assembly;

(e) second actuation means operatively connected to said second rudder assembly for actuating a change in the rotational position of said second rudder assembly;

(f) third actuation means operatively connected to said third rudder assembly for actuating a change in the rotational position of said third rudder assembly, wherein said first and third rudder assemblies are farthest from a keel axis of said vessel; and (g) control means operatively connected to said first and third actuation means for controlling the rotational position of said first and third rudder assemblies independent of one another, said control means further including selection means for selectively defining the operation of said first rudder assembly or said third rudder assembly in one or more predetermined configurations.

19. The flanking rudder system of claim 18, wherein said first, second and third thrust producing devices are propellers.

20. The flanking rudder system according to claim 18, where said first rudder assembly, said second rudder assembly and said third rudder assembly each include a single rudder.

21. The flanking rudder system according to claim 18, where said first rudder assembly, said second rudder assembly and said third rudder assembly each include a pair of rudders connected to said first actuation means, said second actuation means, and said third actuation means, respectively, so as to enable said pair of rudders to remain parallel at all rotational positions.

22. The flanking rudder system according to claim 18, wherein said first, second and third actuation means each comprise an electro-hydraulic mechanical linkage assembly.

23. The flanking rudder system according to claim 18, wherein said control means comprises at least one control lever operatively connected to said first actuation means and said third actuation means, respectively, to control the rotational position of either said first rudder assembly or said third rudder assembly.

24. The flanking rudder system according to claim 18, wherein said selection means comprises a console adjacent to said control means, wherein said console includes an electrical switching device having a plurality of selectable settings corresponding to said predetermined configurations.

25. The flanking rudder system according to claim 18, wherein one of said predetermined configurations defines said first rudder assembly, said second rudder assembly and said third rudder assembly to operate in tandem, such that operation of said control means causes said first, second and third rudder assemblies to remain parallel to one another.

26. The flanking rudder system according to claim 18, wherein one of said predetermined configurations defines said first rudder assembly and said second rudder assembly to remain fixed in a rotational position parallel to said first thrust axis of said first thrust producing device, and wherein the rotational position of said third rudder assembly is controlled by said control means.

27. The flanking rudder system according to claim 18, wherein one of said predetermined configurations defines said second rudder assembly and said third rudder assembly to remain fixed in a rotational position parallel to said third thrust axis of said third thrust producing device, and wherein the rotational position of said first rudder assembly is controlled by said control means.

28. The flanking rudder system according to claim 18, wherein one of said predetermined configurations defines said first rudder assembly and said third rudder assembly to operate opposed to one another, wherein said second rudder assembly is caused to remain parallel to said keel axis, and wherein the rotational position of said first rudder assembly and said third rudder assembly are controlled by said control means.

* * * * *